United States Patent [19]

Olivieri

[11] Patent Number: 4,499,674

[45] Date of Patent: Feb. 19, 1985

[54] SKI BOOT WITH A DEVICE FOR REGISTERING ITS AXIAL ORIENTATION IN REGARD TO THE SKI

[75] Inventor: Icaro Olivieri, Montebelluna, Italy

[73] Assignee: Icaro Olivieri & C. S.p.A., Montebelluna, Italy

[21] Appl. No.: 399,248

[22] Filed: Jul. 19, 1982

[30] Foreign Application Priority Data

Jul. 20, 1981 [IT] Italy ..... 23023 A/81

[51] Int. Cl.[3] ..... A43B 5/04; A63C 9/00

[52] U.S. Cl. ..... 36/117; 36/132; 280/607; 280/623; 280/636

[58] Field of Search ..... 36/117-122, 36/132, 135, 97, 114; 280/607, 611, 613, 623, 636

[56] References Cited

U.S. PATENT DOCUMENTS

| | | | |
|---|---|---|---|
| 3,608,919 | 9/1971 | Lollmann | 280/613 |
| 3,905,613 | 9/1975 | Romeo | 280/623 |
| 3,955,825 | 5/1976 | Kubelka et al. | 36/117 X |
| 4,147,377 | 4/1979 | Plenk | 280/607 X |

*Primary Examiner*—James Kee Chi

*Attorney, Agent, or Firm*—Fleit, Jacobson, Cohn & Price

[57] ABSTRACT

A ski boot is described in which the body of the boot may be moved in a crosswise direction in relation to the sole, in such a way that it may be correctly aligned with respect to the ski. More particularly, the sole has at least one of its ends, the toe or the heel, joined to the body in a gliding manner, by means of an essentially prismatic connection (dovetail). In that way, the body of the boot may be fixed on a ski in the position that is morphologically most suitable for the skier.

6 Claims, 3 Drawing Figures

SKI BOOT WITH A DEVICE FOR REGISTERING ITS AXIAL ORIENTATION IN REGARD TO THE SKI

BACKGROUND OF THE INVENTION

The present invention is directed towards improvements in ski boots and, more particularly, is concerned with a device that is incorporated in the ski boot and which makes it possible to vary the axial orientation in order to correctly align the boot in relation to the ski.

It is well known that a ski boot and, especially, the ski boot sole, must have high rigidity and mechanical resistance for the purpose of attaching the ski as firmly as possible to the skier's foot in order to successfully withstand the stresses transmitted through the bindings during, e.g., the carrying-out of a descent.

When a ski boot, of currently known design, is attached to the appropriate ski, the longitudinal axis of the body of the boot coincides with the longitudinal axis of the attached sole and with the longitudinal axis of the ski. In such a boot it is well known that the foot and the anklebone of the skier are locked in the boot rigidly. Consequently, during actual sport skiing using this equipment, the orientation of the foot of the skier is constrained to coincide with the axis of the ski, regardless of the congenital morphological characteristics of the skier's ankle and knee joints.

When the aforementioned constraint is applied to feet which, in their natural condition of rest, are of the so-called type "with retracted points" or "with convergent points" stresses will appear at these joints, particularly the knee joint, as the sports activities continue or become more technically difficult. These stresses are translated into sensations of pain, combined with inflammation of the tendons or of the ligaments and, in any case, with a gradually increasing feeling of fatigue.

In order to overcome this technical disadvantage, various ideas for the modification of the position of the boot in relation to the ski have been proposed which are intended to satisfy the morphological requirements of the skier. More particularly, it has been suggested that the angular position of the entire boot in relation to the ski be varied, by changing the position of the front part of the binding in a manner that may be, more or less, aligned. It has been recognized, however, that these attempts not only do not always overcome the aforementioned disadvantage, they also entail other technical disadvantages, such as the undesirable and not easily counteracted raising of the centrifugal force components along slightly curved paths. Consequently, the problem addressed by the present invention is to provide a device that can be incorporated into a ski boot and which makes it possible for the boot to be correctly aligned in relation to the ski resulting, at all times, in the most appropriate morphological position given the characteristics of the skier's feet and knees.

SUMMARY OF THE INVENTION

The present invention relates to a ski boot comprising a body and a sole and which is characterized by the fact that the body may be moved, in a manner that may be correctly aligned or registered, in a transverse direction in relation to the sole.

A ski boot in accordance with the present invention is characterized further by the fact that the sole comprises a tip or toe portion that is structurally independent of the rest of the sole and is connected along a sliding path with a corresponding tip or toe portion of the boot body through an essentially prismatic (dovetail) connection.

In an alternate design, a boot in accordance with the present invention is characterized by the fact that the sole comprises a heel portion that is structurally independent of the rest of the sole and is connected along a sliding path with a corresponding heel portion of the body through an essentially prismatic (dovetail) connection. This connection is oriented in a direction transverse to the sole itself, and has means for detachably fastening the body to the sole.

In the preferred embodiment of the invention a ski boot is characterized by the fact that the sole comprises a tip or toe section and a heel section that are each structurally independent of the remaining or central sole part. The toe and heel sections are connected along transverse sliding paths with the corresponding sections of the body, and means are provided for detachably locking the parts of the sole to the body.

A major advantage achieved by a ski boot constructed in accordance with this invention arises from the fact that the boots registrable positioning (alignment) in relation to the ski may be achieved without modifying, even minimally, the position of the binding or of the sole on the ski itself, so that the morphological adaptation does not entail the technical inconveniences explained above.

Additional characteristics and advantages will become more clearly evident from the description of an embodiment of the invention, given with reference to the attached drawings, the description and drawings presented solely by way of example and not intended to limit the invention in any way.

DETAILED DESCRIPTION OF THE DRAWINGS

Figure 1:
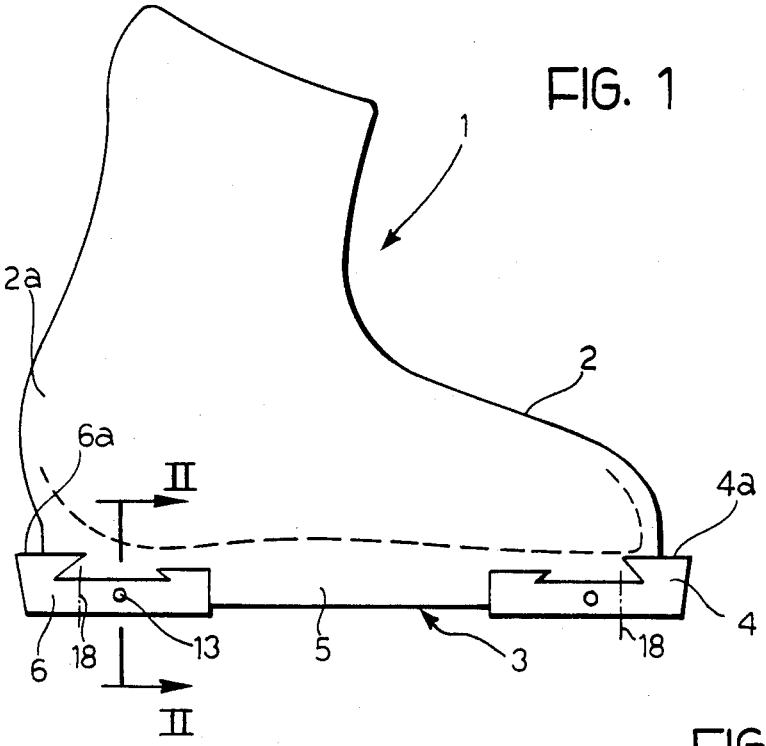
FIG. 1 presents a schematic lateral view of a ski boot in accordance with the invention.

With reference to the Figures, reference number 1 generally designates a ski boot in accordance with the invention; it comprises a body 2 and a sole 3. The sole 3, in its turn, comprises three parts: an anterior, tip or toe part 4; a central part 5; and a posterior or heel part 6.

In accordance with a preferred embodiment of the invention, the central part 5 of the sole 3 is integrally formed with the body 2 of the boot, following conventional techniques of plastic molding. The tip or toe 4 and heel 6 sections are structurally independent of the sole 3 as well as of the body 2 and are attached to the body along a sliding path by means of largely prismatic (dovetail) connections that will be described in detail below. In particular, the fastening means of the parts 4 and 6 are similar and for that reason only the heel section 6 will be described in detail.

Figure 3:
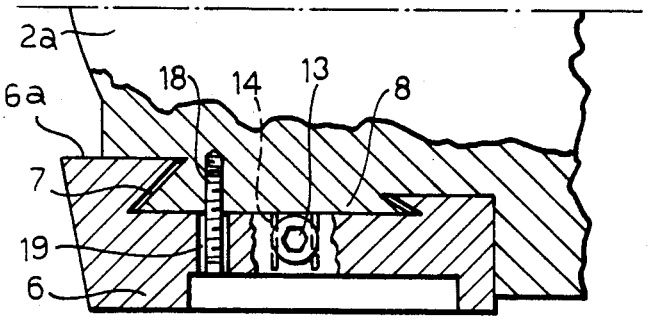
FIG. 3 is an enlarged section along the line III—III of FIG. 2.

Referring to FIG. 3, in the heel section 6, a guide-groove 7 has been hollowed out, essentially in the form of a dovetail joint, the groove extending perpendicular to the longitudinal axis of the sole 3. Guide-groove 7 is slidingly connected with a counter-guide 8, having a conjugate profile, which is hollowed out in the part 2*a* of the heel of the body 2.

Figure 2:
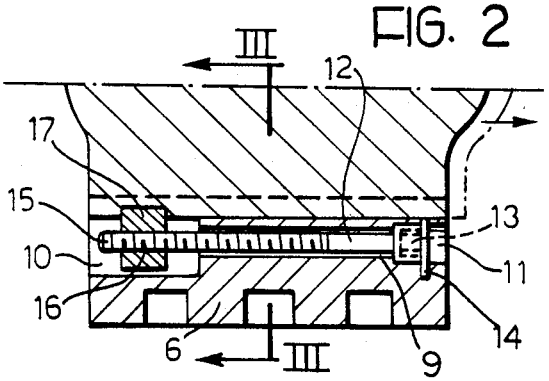
FIG. 2 is an enlarged section along the line II—II of FIG. 1.

In a position parallel to and below the guide-groove 7, a passageway 9 is formed having larger slots 10 and 11 at each end which open onto opposite faces of the heel section (FIG. 2). A screw 12 of predetermined pitch is placed in the passageway 9 in such a way that it may be rotated; the head 13 of screw 12 is held by a conventional shoulder 14 which is supported in the slot 11. The free threaded end 15 of screw 12 engages the threaded opening 16 which is formed in a block 17 attached to the body 2 and extending into the aforementioned slot 10.

The heel part 6 is attached to the body by means of a number of (e.g., two) screws 18 (FIG. 3) that engage pertinent openings 19 which have been hollowed out in part 6 of the sole, the screws 18 being inserted into holes formed in the heel section 2*a* of the body. In particular, the openings 19 are in the form of a button-hole stretched out in a direction parallel to the screw 12.

It is to be noted that both the tip or toe section 4 and the heel section 6 of the sole 3, extend over a predetermined distance in relation to the body 2, so as to form the traditional and conventional edges 4*a* and 6*a* that are designed to engage conventional and traditional ski bindings (not shown).

The locking or securing of a boot on a ski in accordance with the invention, and the selection of the axial position that is morphologically most suitable for the anatomical characteristics of the foot of the user will be fully evident. In particular, after locking the boot to the ski by means of conventional ski bindings which engage the front edges 4*a* and the rear edges 6*a* of the boot, the skier proceeds, by means of screws 12, to orient the boot body 2 in relation to the tip 4 and heel 6 sections of the sole, and as a result in relation to the ski. To that end, the user will simply have to screw or unscrew the screw 12 of one or both of the aforementioned sections, in order to determine the displacements of the body 2 in the guide-groove 7 of the parts of the sole, in order that the boot body will assume the angular position in relation to the ski that is most suitable given the skier's morphology. It must be stressed that, for the case illustrated, the angular displacements are made possible by the clearances (play) that are, of necessity, present in the prismatic (dovetail) connections described above, and by the elastic or elastoplastic deformability of the material of which the sole and the body of the shoe have been made. In addition, it must be noted that the desired orientation of the body in relation to the ski does not imply any modifications of the position of the bindings on the ski itself, which is very important for the optimal adjustment of the sport skier.

The invention that has been described in terms of a preferred embodiment is susceptible of variations and modifications without departing from the spirit of the invention. Thus, e.g., the sole 3 of the shoe in accordance with this invention may comprise only one section (heel or tip section) that is slidably connected to a corresponding section of the body, while the other section may be united with the body by means of a pivoting device. The angular displacements of the body for the selection of the morphologically most suitable position may be facilitated by forming the aforementioned connection with a predetermined curvilinear profile.

It will be appreciated by those skills in the art that other changes or modifications are possible which do not depart from the inventive concepts described and taught herein. Such changes and modifications are deemed to fall within the purview of these inventive concepts.

What is claimed is:

1. A ski boot comprising a body, a sole, and means for allowing said body to move in a direction transverse to the longitudinal axis of the sole, in such a way that the movement may be registered, wherein said sole includes a tip section and prismatic connection means, said tip section being independent of the rest of the sole and of the body of the boot, a corresponding tip section of said body being connected along a sliding path with said tip section of the sole through said prismatic connection means extending in a transverse direction in relation to the sole, and further comprising means for detachably locking said body to said tip section of said sole.

2. A ski boot in accordance with claim 1, wherein said sole includes a heel section and prismatic connection means, said heel portion being structurally independent of the rest of the sole and of the body of the boot, said heel section being connected along a sliding path with a corresponding heel section of said body through said prismatic connection means which extend in a transverse direction in relation to the sole itself and further comprising means for detachably locking said body to said section of said sole.

3. A ski boot in accordance with claim 1, further comprising prismatic connection means, and wherein said sole comprises a tip section, a heel section and a central remaining section, that said tip section and said heel section being structurally independent of the remaining section of the sole and of the body, said tip and heel sections each being connected along a sliding path with the corresponding tip and heel sections of the body through pertinent, prismatic connection means which extend in a transverse direction in relation to the sole, and further comprising means for detachably locking said sections of said sole to said body.

4. A ski boot comprising: a boot body; a sole; and connecting means for moveably connecting said sole to said boot body, so that said boot body may be aligned in a desired transverse position in relation to said sole, wherein said sole comprises a toe portion and a remaining portion, said remaining portion being integrally formed with said boot body, and said toe portion being independent of both said boot body and said remaining portion, and wherein said connecting means comprises a prismatic joint for joining said toe portion to said boot body, and a locking means for holding said toe portion in a position relative to said boot body.

5. A ski boot according to claim 5, wherein said sole comprises a heel portion and a remaining portion, said remaining portion being integrally formed with said boot body, and said heel portion being independent of both said boot body and said remaining portion, and wherein said connecting means comprises a prismatic joint for joining said heel portion to said boot body, and a locking means for holding said heel portion in a given position relative to said boot body.

6. A ski boot according to claim 5, wherein said sole comprises a toe portion, a heel portion and a remaining central portion, said remaining central portion being integrally formed with said boot body, and said toe portion and heel portion each being independent of both said boot body and said remaining central portion, and wherein said connecting means comprises a first prismatic joint formed between the boot body and the toe portion and a second prismatic joint formed between the boot body and the heel portion, each joint having locking means for holding said joint in a given position relative to said boot body.

* * * * *